US005243715A

United States Patent [19]

Barmak

[11] Patent Number: 5,243,715

[45] Date of Patent: Sep. 14, 1993

[54] SHOWER ENCLOSURE

[76] Inventor: Vladislav Barmak, 390 Queens Quay West, Apt. 1309, Toronto, Ontario, Canada, M5A 2V6

[21] Appl. No.: 862,339

[22] Filed: Apr. 2, 1992

[51] Int. Cl.[5] ..... A47K 3/22; E05D 15/50

[52] U.S. Cl. ..... 4/558; 4/597; 4/608; 160/202

[58] Field of Search ..... 4/557, 558, 608, 597; 160/196.1, 349

[56] References Cited

U.S. PATENT DOCUMENTS

| | | | |
|---|---|---|---|
| 2,120,155 | 6/1938 | Shera | 4/558 X |
| 3,062,279 | 11/1962 | Kochanowski | 160/196.1 |
| 3,321,781 | 5/1967 | Reich . | |
| 3,500,481 | 3/1970 | McKwane | 4/558 |
| 3,895,399 | 7/1975 | Glarrante . | |
| 4,014,378 | 3/1977 | Kochanowski | 160/196.1 X |
| 4,202,059 | 5/1980 | Faragher, Jr. . | |
| 4,754,504 | 5/1988 | Cellini | 4/605 X |

FOREIGN PATENT DOCUMENTS

| | | |
|---|---|---|
| 2514632 | 10/1981 | France . |
| 2105645 | 3/1983 | United Kingdom . |

*Primary Examiner*—Daniel M. Yasich

*Attorney, Agent, or Firm*—Webb, Burden, Ziesenheim & Webb

[57] ABSTRACT

A shower enclosure is provided in which the conventional shower curtain is replaced by a combination of rigid sliding panels and an intermediate pliable curtain portion. The rigid panels define an outward contour which provides additional space for movement within the shower. The enclosure of the present invention is of simple and inexpensive construction and is easy to install.

18 Claims, 4 Drawing Sheets

SHOWER ENCLOSURE

FIELD OF THE INVENTION

This invention relates in general to shower enclosures, and more particularly to a shower enclosure having an outward contour to provide additional space in the shower.

BACKGROUND OF THE INVENTION

It is well known in the art to provide shower curtains for retaining water in a confined area. The conventional shower curtain is in the form of a plastic sheet which is suspended from a horizontal curtain rod via curtain rings. When closed over the entrance/exit to the shower or bathtub, the shower curtain functions to prevent water spillage outside of the shower. This prior art design suffers from the disadvantage that the curtain has a tendency to billow around the person who is showering, such that the bottom and side edges of the curtain part from the shower enclosure and allow water to escape, causing spillage, etc.

In an effort to overcome this problem, some shower curtains have been designed with magnets disposed in the bottom or hem edge. However, this solution does not work with plastic or other non-magnetic bathtubs.

It is also known in the art to provide sliding glass doors for enclosing showers and bathtubs. However, the sliding glass door units are of expensive and complex construction, and can be unwieldy in use due to the extreme weight of the glass.

Both of the prior art plastic curtain and glass door enclosures suffer from the additional significant disadvantage that the usable space in the shower is limited generally to the width of the bathtub, since the curtain or glass door forms a substantially vertical plane at the entrance/exit edge of the bathtub.

Additional prior art enhancements to shower curtain design are known which do not address the disadvantage discussed above relating to the lack of usable shower space. For example, U.S. Pat. No. 4,202,059 (Faragher, Jr.) discloses a reversible shower curtain of two-sheet laminated design; U.S. Pat. No. 3,895,399 (Giarrante) discloses an upstanding corner flange spray diverter for use in combination with a conventional shower curtain; U.S. Pat. No. 3,321,781 (Reich) discloses a shower curtain with reinforcing plastic strips; U.K. Patent Application GB 2,105,645 (The Croydex Company) discloses a method of ultrasonic welding of a nylon sheet shower curtain to form reinforced holes thereby eliminating the necessity of using metal eyelets; and French Patent Application 81 19796 (Deveze) discloses a shelf structure which is adapted to be suspended from a shower curtain rod on the inside of a shower curtain.

SUMMARY OF THE INVENTION

According to the present invention, there is provided a shower enclosure in which the conventional shower curtain is replaced by a combination of rigid sliding panels and an intermediate pliable curtain portion. The rigid panels define an outward contour which provides additional space for movement within the shower. The enclosure of the present invention is of simple and inexpensive construction and is safe and easy to install. The ease of assembly and disassembly contributes to increased mobility (e.g. in the event of a move, the user can easily disassemble the unit and take it with him/her to a new place of residence.)

In accordance with a general aspect of the present invention there is provided a shower enclosure adapted to be connected to a horizontal shower curtain rod for enclosing a bathtub bounded on three adjacent sides by walls, comprising a plurality rigid panels adapted to be connected at top and bottom portions thereof to said rod and a side ledge of said bathtub, respectively, said plurality of panels projecting from said rod and said side ledge outwardly of said bathtub, a pliable shower curtain connected to two of said panels so as to extend therebetween, at least one of said two panels being adapted to slide laterally on said rod and said side ledge for opening and closing said shower curtain to provide access to said bathtub.

According to another aspect of the invention there is provided a shower enclosure for connection to a shower curtain rod and a side ledge of a bathtub, comprising:

a) a pair of stationary panels extending between said shower curtain rod and said side ledge of the bathtub and disposed at opposite ends of said rod;

b) a pair of movable panels intermediate said pair of stationary panels, said movable panels being adapted to slide on said shower curtain rod; and c) a pliable shower curtain connected to said pair of movable panels.

BRIEF DESCRIPTION OF THE DRAWINGS

A detailed description of the preferred embodiment is provided below with reference to the following drawings, in which.

DETAILED DESCRIPTION OF THE PREFERRED EMBODIMENT

Turning to FIGS. 1–11, the shower enclosure of the present invention is shown according to the preferred embodiment. In particular, the shower enclosure is shown comprising a plurality of rigid panels 2, 4, 6 and 8, and an intermediate pliable (eg. nylon or plastic) sheet 10.

Figure 1:
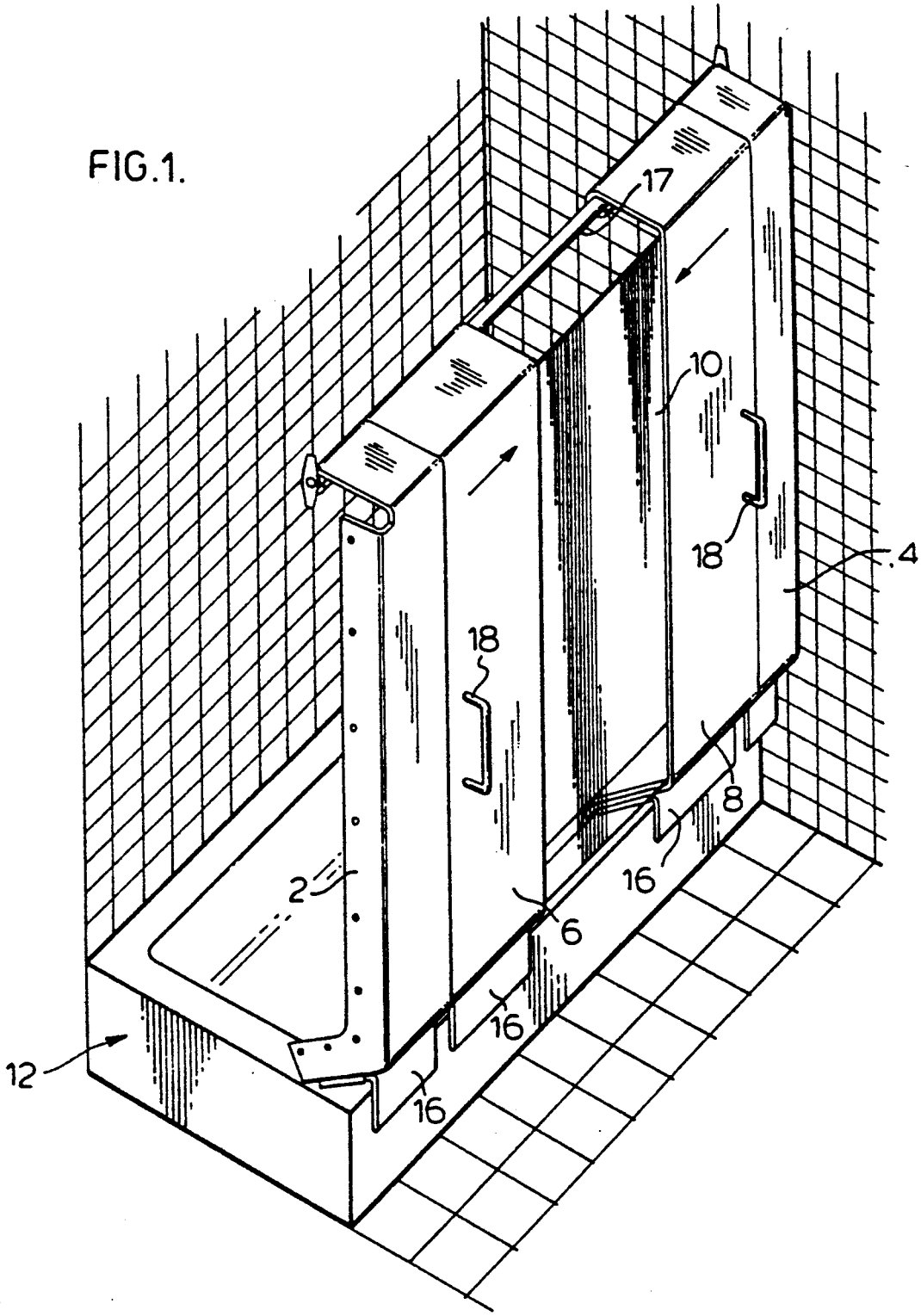
FIG. 1 is a perspective view of a shower enclosure according to the preferred embodiment.
Figure 2:
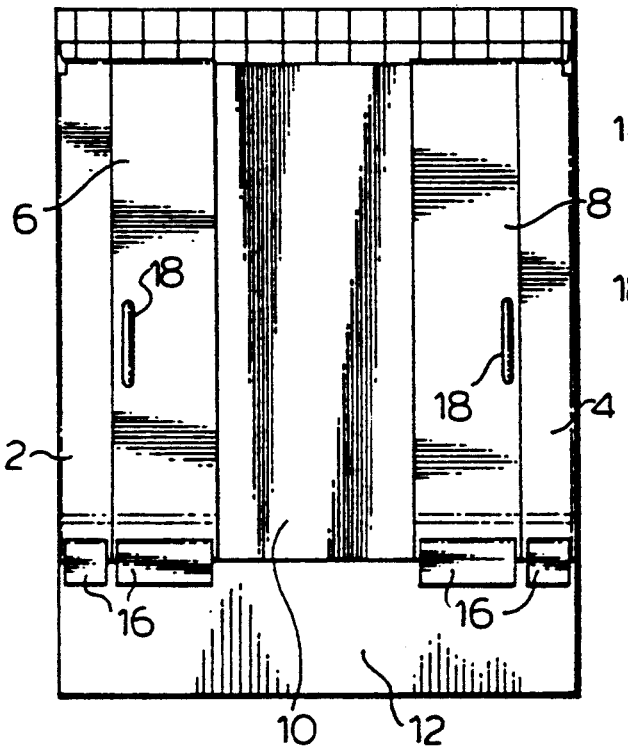
FIG. 2 is a front elevation view of the shower enclosure of FIG. 1.
Figure 3:
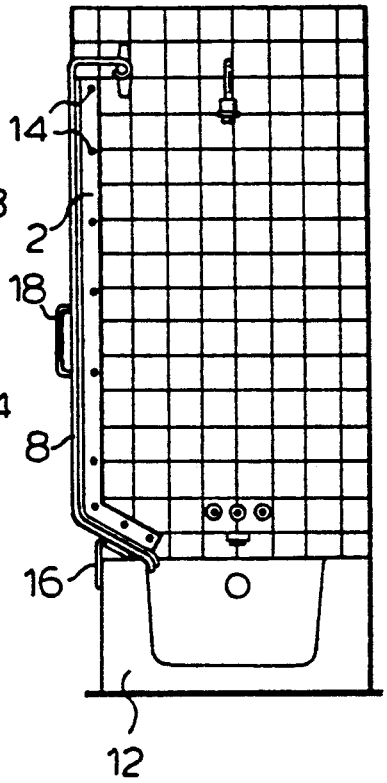
FIG. 3 is a side view of the shower enclosure of FIG. 1.
Figure 4:
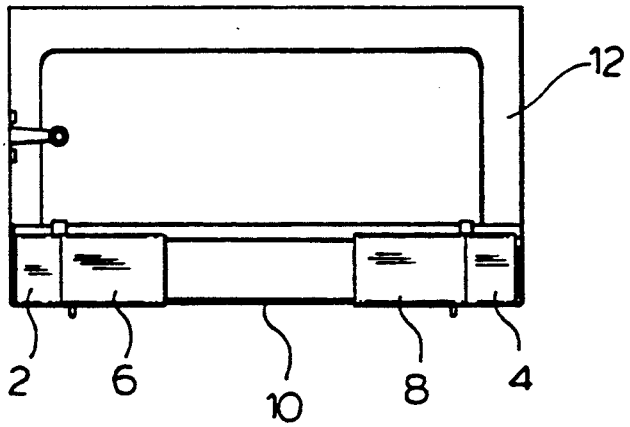
FIG. 4 is a top plan view the shower enclosure of FIG. 1.
Figure 7:
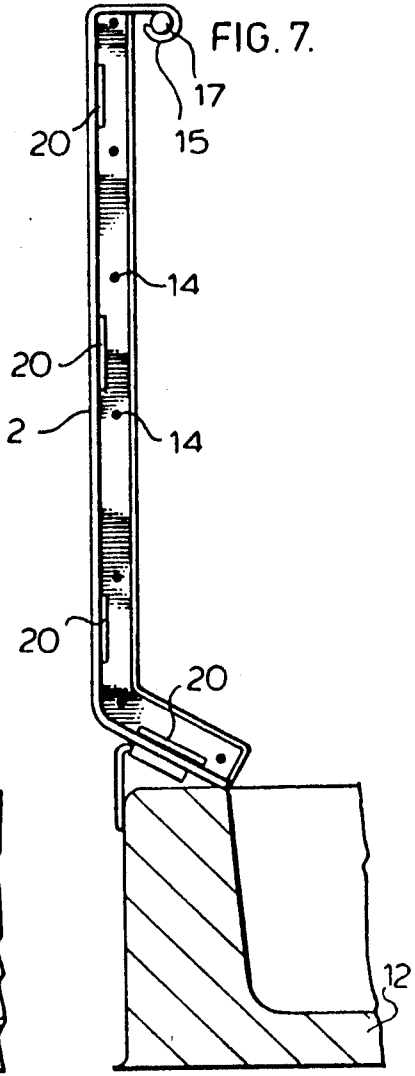
FIG. 7 is a cross-sectional side view through an end panel of the shower enclosure of the present invention.

The end panels 2 and 4 may be connected to opposite walls surrounding the bathtub 12 via screws 14 (FIGS. 3 and 7). Alternatively, the end panels 2 and 4 may be secured to the adjacent respective walls via suction cups, two-faced tape, or other suitable attachment means.

Inner panels 6 and 8 are supported from beneath and are adapted to slide laterally on a sliding rim attachment 16. To this end, a pair of handles 18 are provided on the inner sliding panels 6 and 8 for opening and closing the panels to gain access to and exit from the bathtub 12. The end units 2 and 4 are also each supported on a rim attachment 16 but are prevented from sliding by attachment screws 14.

Figure 6:
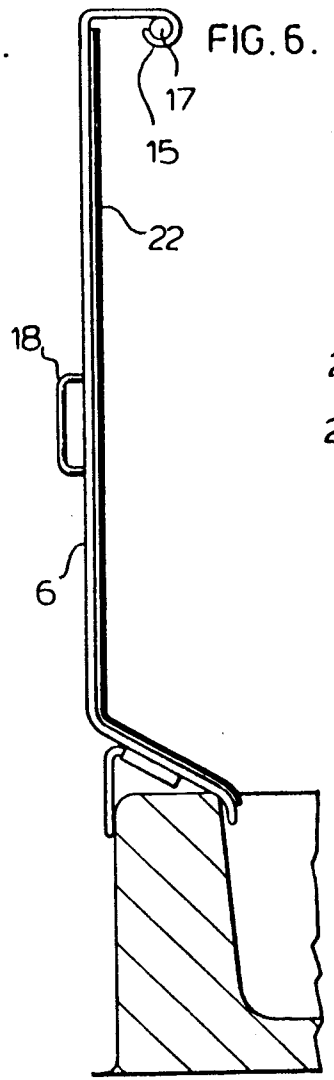
FIG. 6 is a cross-sectional side view through a sliding panel of the shower enclosure of the present invention.
Figure 5:
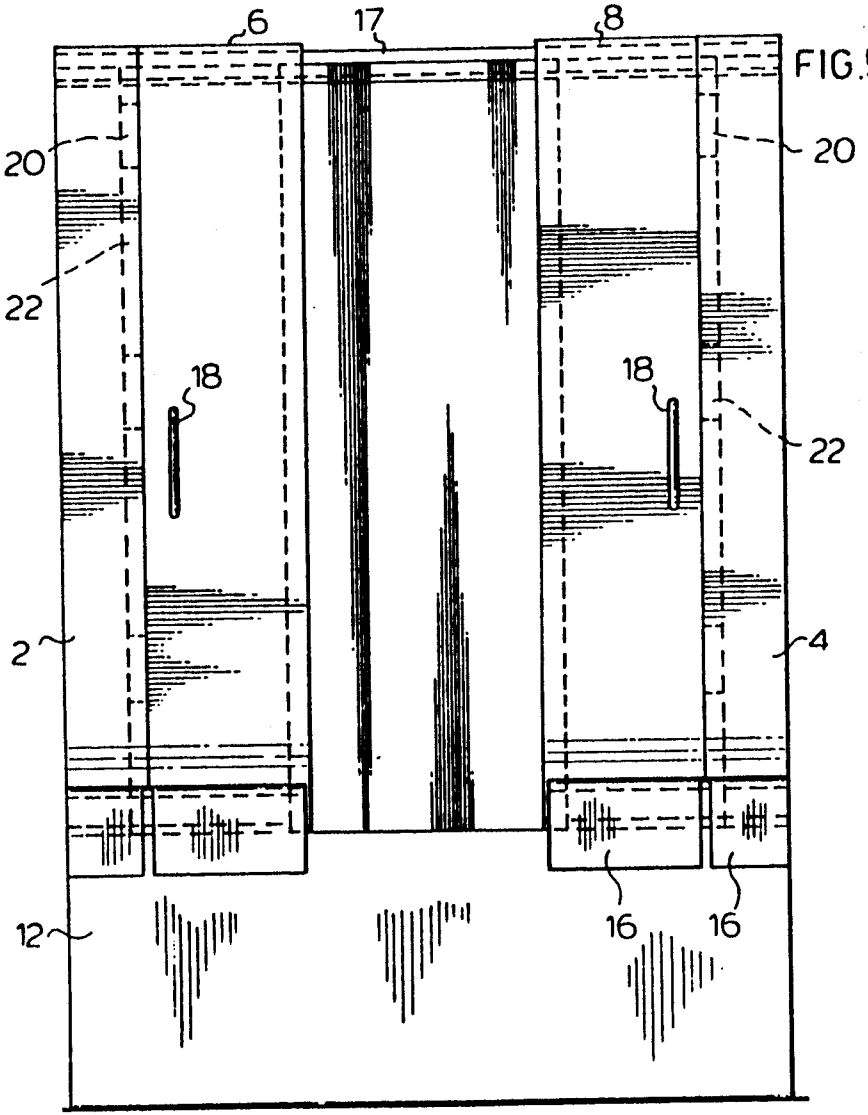
FIG. 5 is a front elevation view of the shower enclosure of FIG. 2 with hidden lines denoting additional structural features.

The panels 2, 4, 6 and 8 are suspended from above by virtue of a hook-shaped curved portion 15 as shown in FIGS. 5–7 which circumscribes a conventional cylindrical shower curtain rod 17.

The curtain portion 10 is connected to the sliding panels via Velcro TM, two-faced tape or other suitable attachment means. The curtain portion may be transparent, coloured, or may include graphic designs, etc.

According to an important aspect of the present invention, the rigid panels 2, 4, 6 and 8 are contoured outwardly relative to the bathtub 12 for providing additional space within which to shower. This has the advantage of allowing for a greater range of personal movement in the shower, which is a significant feature to persons suffering from physical disabilities. Although the profile shown in the preferred embodiment of FIGS. 1 to 11 defines a generally rectangular space, other profiles or contours of panel are possible such as trapezoidal, curved (eg. convex), stepped, etc.

Turning to the detailed views of FIGS. 5 to 7, the interface between the stationary end panels and the sliding panels 6 and 8 is shown in greater detail as comprising tongue portions 20 projecting from the end panels 2 and 4, and a cooperatively shaped groove portion 22 in each of the sliding panels 6 and 8. When the sliding panels 6 and 8 are in the closed position, the tongue portions 20 are received within the groove portion 22 so as to form a water-tight connection which resists accidental opening of the enclosure when in use, as shown in greater detail below with reference to FIG. 1.

Figure 8:
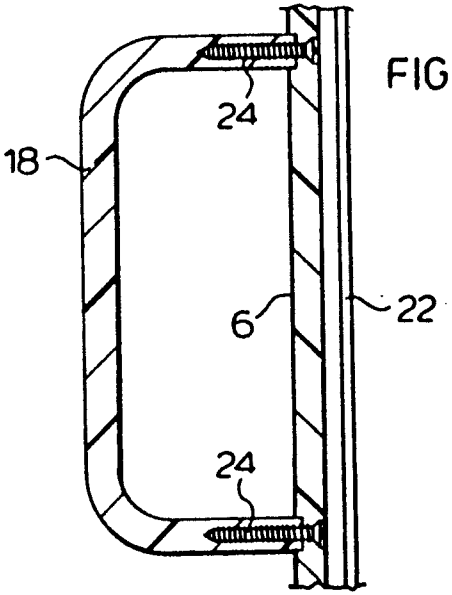
FIG. 8 is a detail cross-sectional view through a handle portion of the sliding panel shown in FIG. 6.

As shown in FIG. 8, the handles 18 may be connected to the sliding inner panel 6 or 8 via screws 24, in a well known manner.

Figure 9:
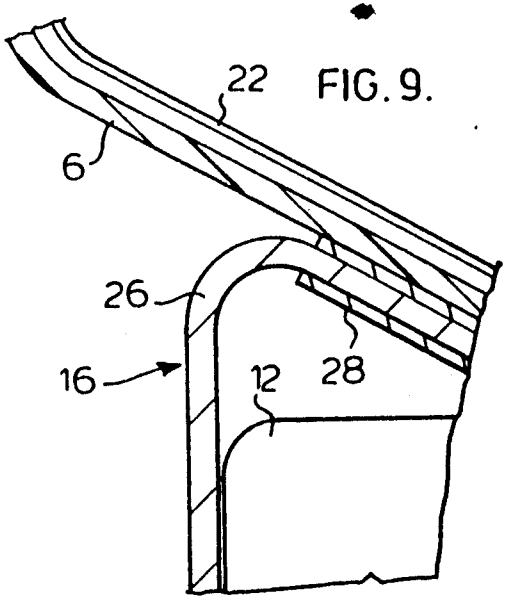
FIG. 9 is a detail cross-sectional view through a rim attachment at the base of the sliding panel shown in FIG. 6.

The sliding rim attachment 16 is shown in greater detail with reference to FIG. 9. In particular, the panel 6 curves at the bottom from outside to inside of the bathtub 12 and over the side ledge or rim thereof. A base unit 26 is connected to the lower outer surface of the panel 6 via an intermediate member 28 which can be glued, welded, or otherwise affixed to the bottom of the panel 6.

The rim attachment 16 discussed with reference to panel 6 in FIG. 9 is the same in construction and operation as the rim attachment 16 connected to panels 2, 4 and 8.

Figure 10:
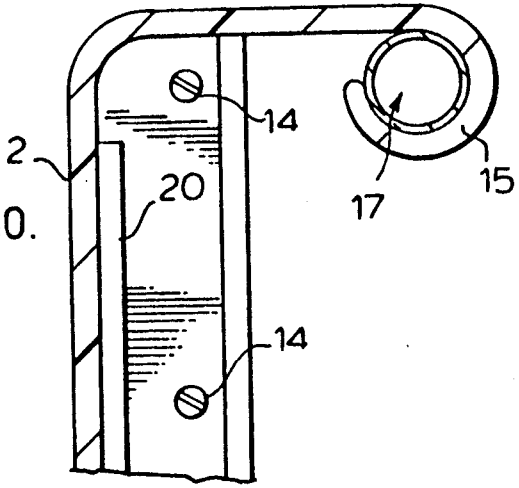
FIG. 10 is a detail cross-sectional view through a shower rod attachment of the end panel shown in FIG. 7.

The hook-shaped curved portion 15 by which the panels are suspended from the curtain rod 17 is shown in greater detail with reference to FIG. 10.

Figure 11:
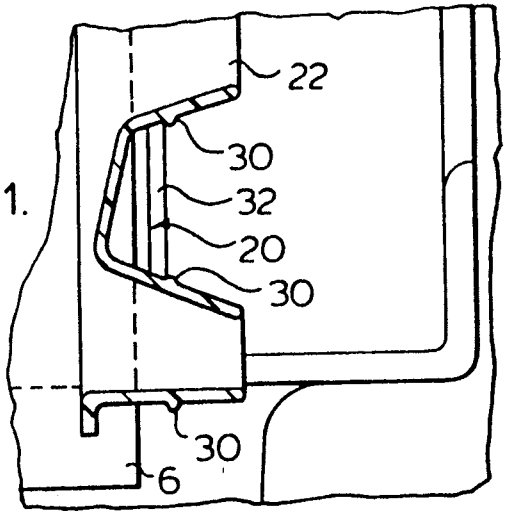
FIG. 11 is a detail cross-sectional view showing a tongue and groove interconnection between a sliding panel and an end panel according to the preferred embodimen.

In FIG. 11, a view is provided from inside the bathtub 12 toward the outside of a tongue portion 20 on the stationary end panel 2 received within the cooperatively shaped groove portion 22 of the sliding panel 6. The groove portion 22 is shown in partial cross section for illustrating the connection to tongue portion 20. A similar arrangement is provided on stationary end panel 4 and sliding panel 8. As shown in FIG. 11, the groove portion 22 preferably includes a round projection 30 which, is adapted to engage a similar projection 32 from tongue portion 20. The cooperating projections 30 and 32 provide loose interlocking of the sliding and stationary panels when the panels are in the closed position.

The panels 2, 4, 6 and 8 are preferably fabricated from high impact injection moulded plastic. This material is used because it is durable, light weight, inexpensive, and exhibits high tensile strength. The panels can be injection moulded in a variety of colours.

Other modifications and variations of the invention are possible. For example, it is contemplated that depressions could be moulded into the panels 2, 4, 6 and 8 for holding soap and shampoo bottles, etc. All such modifications and variations are believed to be within the sphere and scope of the invention as defined by the claims appended hereto.

I claim:

1. A shower enclosure adapted to be connected to a horizontal shower curtain rod for enclosing a bathtub bounded on three adjacent sides by walls and having a side ledge, comprising two rigid stationary end panels and two rigid intermediate sliding panels, each of said panel adapted to be connected at top and bottom portions thereof to said rod and to a side ledge of said bathtub, respectively, each of said panels projecting from said rod and said side ledge outwardly of said bathtub, a pliable shower curtain connected to said two rigid intermediate sliding panels so as to extend therebetween, said two intermediate sliding panels adapted to slide laterally on said rod and said side ledge for opening and closing said shower curtain to provide access to said bathtub, and a tongue and groove interface between said two stationary end panels and said two intermediate panels.

2. The shower enclosure of claim 1 further including a handle on each of said intermediate sliding panels to facilitate opening and closing of said shower curtain.

3. The shower enclosure of claim 1 wherein each of said panels is connected at the top via a hook-shaped curved portion which circumscribes said shower curtain rod.

4. The shower enclosure of claim 1 wherein said stationary end panels are connected to opposite ends of said walls via attachment means.

5. The shower enclosure of claim 4 wherein said attachment means comprise screws.

6. The shower enclosure of claim 1 wherein each of said panels is fabricated from high impact injection moulded plastic.

7. A shower enclosure for connection to a shower curtain rod and a side ledge of a bathtub, comprising:

a) a pair of stationary panels extending between said shower curtain rod and said side ledge of the bathtub and disposed at opposite ends of said rod;

b) a pair of movable panels intermediate said pair of stationary panels, said movable panels adapted to slide on said shower curtain rod;

c) a pliable shower curtain connected to said pair of movable panels; and d) a tongue and groove interface between said pair of stationary panels and said pair of movable panels.

8. The shower enclosure of claim 7 wherein each of said pair of stationary panels and said pair of movable panels project from said rod and said side ledge outwardly of said bathtub.

9. The shower enclosure of claim 7 further including a handle on each of said pair of panels to facilitate opening and closing of said shower curtain.

10. The shower enclosure of claim 7 wherein each one of said pair of stationary panels and said pair of movable panels is connected to said curtain rod via a hook-shaped curved portion which circumscribes said shower curtain rod.

11. The shower enclosure of claim 7 further comprising a rim attachment for supporting said pair of stationary panels and said pair of movable panels on said side ledge of said bathtub.

12. The shower enclosure of claim 11 wherein each one of said pair of stationary panels an pair of movable panels curves at the bottom thereof from outside to inside of said side ledge of said bathtub.

13. The shower enclosure of claim 12 wherein said rim attachment further comprises a base unit connected to a lower outer surface of each one of said pair of stationary panels and said pair of movable panels via an intermediate member.

14. The shower enclosure of claim 7 wherein said pair of stationary panels and said pair of movable panels are fabricated from high impact injection moulded plastic.

15. A shower enclosure adapted to be connected to a horizontal shower curtain rod for enclosing a bathtub bounded on three adjacent sides by walls and having a side ledge, comprising a plurality of rigid panels adapted to be connected at top and bottom portions thereof to said rod and to said side ledge of said bathtub, respectively, said plurality of panels projecting from said rod and said side ledge outwardly of said bathtub, a pliable shower curtain connected to two of said panels so as to extend therebetween, at least one of said two panels being adapted to slide laterally on said rod and said side ledge for opening and closing said shower curtain to provide access to said bathtub, a rim attachment on the bottom of each of said plurality of rigid panels for supporting said plurality of rigid panels on said side ledge of said bathtub, and wherein the bottom of each of said plurality of rigid panels is curved from outside to inside of said side ledge of said bathtub.

16. The shower enclosure of claim 15 wherein said rim attachment includes a base unit connected to a lower outer surface of the bottom of each of said plurality of rigid panels by an intermediate member.

17. A shower enclosure for connection to a shower curtain rod and a side ledge of a bathtub, comprising:

a) a pair of spaced stationary panels extending between said shower curtain rod and said side ledge of said bathtub and disposed at opposite ends of said rod;

b) a pair of movable panels intermediate said spaced stationary panels, said movable panels adapted to slide on said shower curtain rod;

c) a pliable shower curtain connected to said pair of movable panels;

d) a rim attachment for supporting said pair of stationary panels and said pair of movable panels on said side ledge of said bathtub; and e) wherein the bottom of each of said stationary panels and each of said movable panels is curved from outside to inside of said side ledge of said bathtub.

18. The shower curtain enclosure of claim 18 wherein said rim attachment includes a base unit connected to a lower outer surface of the bottom of each one of said pair of stationary panels and each of said movable panels by an intermediate member.

* * * * *

UNITED STATES PATENT AND TRADEMARK OFFICE

CERTIFICATE OF CORRECTION

PATENT NO. : 5,243,715
DATED : September 14, 1993
: Vladislav Barmak

It is certified that error appears in the above-indentified patent and that said Letters Patent is hereby corrected as shown below:

Column 3 Line 46 "1" should read --11--.

Claim 1 Line 28 Column 4 "panel" should read --panels--.

Claim 9 Line 4 Column 5 before "panels" insert --movable--.

Claim 12 Line 16 Column 5 "an" should read --and said--.

Claim 18 Line 31 Column 6 "claim 18" should read --claim 17--.

Signed and Sealed this

Twenty-second Day of March, 1994

*Attest:*

Bruce Lehman

BRUCE LEHMAN

*Attesting Officer*

*Commissioner of Patents and Trademarks*